US005519382A

United States Patent [19]

Pope et al.

[11] Patent Number: 5,519,382

[45] Date of Patent: May 21, 1996

[54] MOBILE FIRE DETECTOR SYSTEM

[75] Inventors: Tim E. Pope; Patrick T. Borns, both of Valparaiso, Ind.

[73] Assignee: McDaniel Fire Systems, Inc., Valparaiso, Ind.

[21] Appl. No.: 196,483

[22] Filed: Feb. 15, 1994

[51] Int. Cl.[6] ..... G08B 21/00

[52] U.S. Cl. ..... 340/627; 340/628; 340/629; 340/630; 340/632; 340/693

[58] Field of Search ..... 340/628, 630, 340/632, 693, 629, 627

[56] References Cited

U.S. PATENT DOCUMENTS 3,866,687 2/1975 Banner ..... 169/61
4,764,758 8/1988 Skala ..... 340/627
4,968,975 11/1990 Fritz ..... 340/628
5,019,805 5/1991 Curl et al. ..... 340/628

*Primary Examiner*—Brent A. Swarthout
*Assistant Examiner*—Julie B. Lieu
*Attorney, Agent, or Firm*—Brett A. Schenck

[57] ABSTRACT

A mobile fire detecting system for detecting fire conditions at the incipient stage before visible smoke has been released having an air sampling fire detector mounted to a cart supported by wheels. A tubular network in communication with the air sampling detector has a manifold enclosed by a box with four sensing hoses releaseably connected to the lateral outlets of the manifold and a telelscoping mast supporting the manifold to position it at selectable heights. Four sampling heads are connected to the other ends of the sensing hoses and are peripherally spaced equally so that the maximum area is sampled for air to detect fire conditions.

11 Claims, 10 Drawing Sheets

MOBILE FIRE DETECTOR SYSTEM

BACKGROUND OF THE INVENTION

The present invention relates to a mobile system for detecting fires at the incipient stage before visible smoke is released in a particular area of a building.

Due to remodeling, maintenance and/or system failures, existing fixed fire detection systems such as sprinkler systems must be taken out of service for long periods at a particular area. During these periods, some of these facilities are unprotected until the existing system is restored to operation. Other facilities have a trained professional walking periodically into the unprotected areas to check for any fire conditions. However, this procedure is costly due to the human labor involved and is not infallible due to the likelihood of a fire occurring while they are not checking an unprotected area. This invention will eliminate the need for any personnel to watch for fire conditions and will provide a temporary highly sensitive fire detector until the existing fire detection system is restored to its normal working order.

Hence, it is an object of the present invention to provide a mobile fire detection system which will detect fires at the incipient stage prior to combustion.

It is a further object of the present invention to notify proper personnel of the detected fire condition so that they can respond accordingly to minimize any fire damage.

It is another object of the present invention to provide a mobile fire detection system which can be adjusted to detect for fire conditions at selected ceiling heights.

SUMMARY OF THE INVENTION

The present invention is directed to a mobile fire detector system for detecting fire conditions at the incipient stage before visible smoke has been released. The system comprises a body supported by wheels to transport the system to different areas, and an air sampling fire detector carried by the body. A tubular network in communication with the air sampling fire detector includes a plurality of heads for sampling air in the surrounding area. A blower means is operatively associated with the air sampling fire detector to draw the sampled air through the heads and through the tubular network into the air sampling fire detector to test the sampled air for fire conditions. A positioning means is operatively associated with the tubular network for positioning the heads at selected heights.

BRIEF DESCRIPTION OF THE DRAWINGS

These and other features, aspects and advantages of the present invention will become better understood with regard to the following description, appended claims, and accompany drawings where:

DETAIL DESCRIPTION OF THE INVENTION

Figure 1:
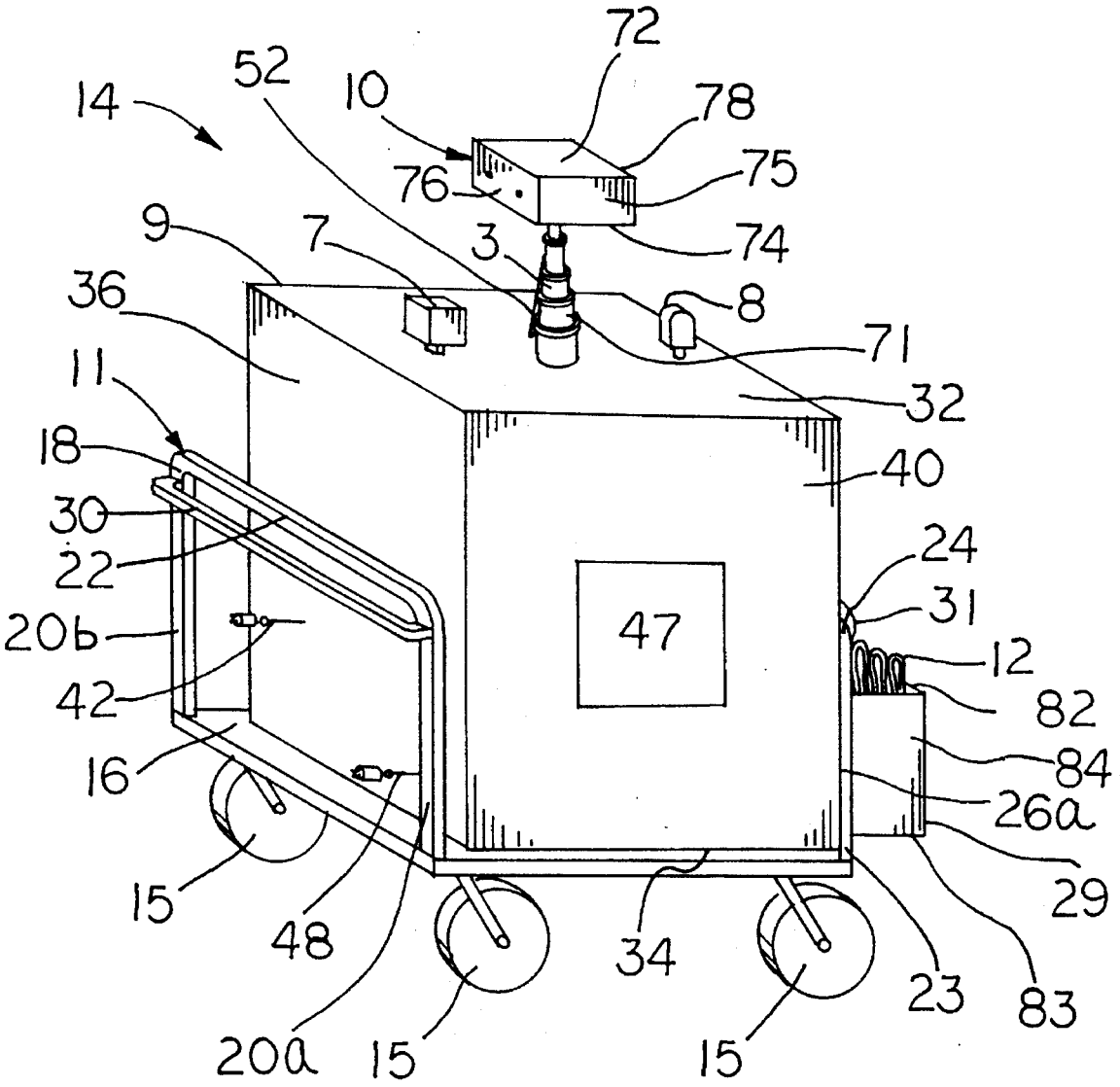
FIG. 1 shows a perspective view of the mobile fire detector system.
Figure 2:
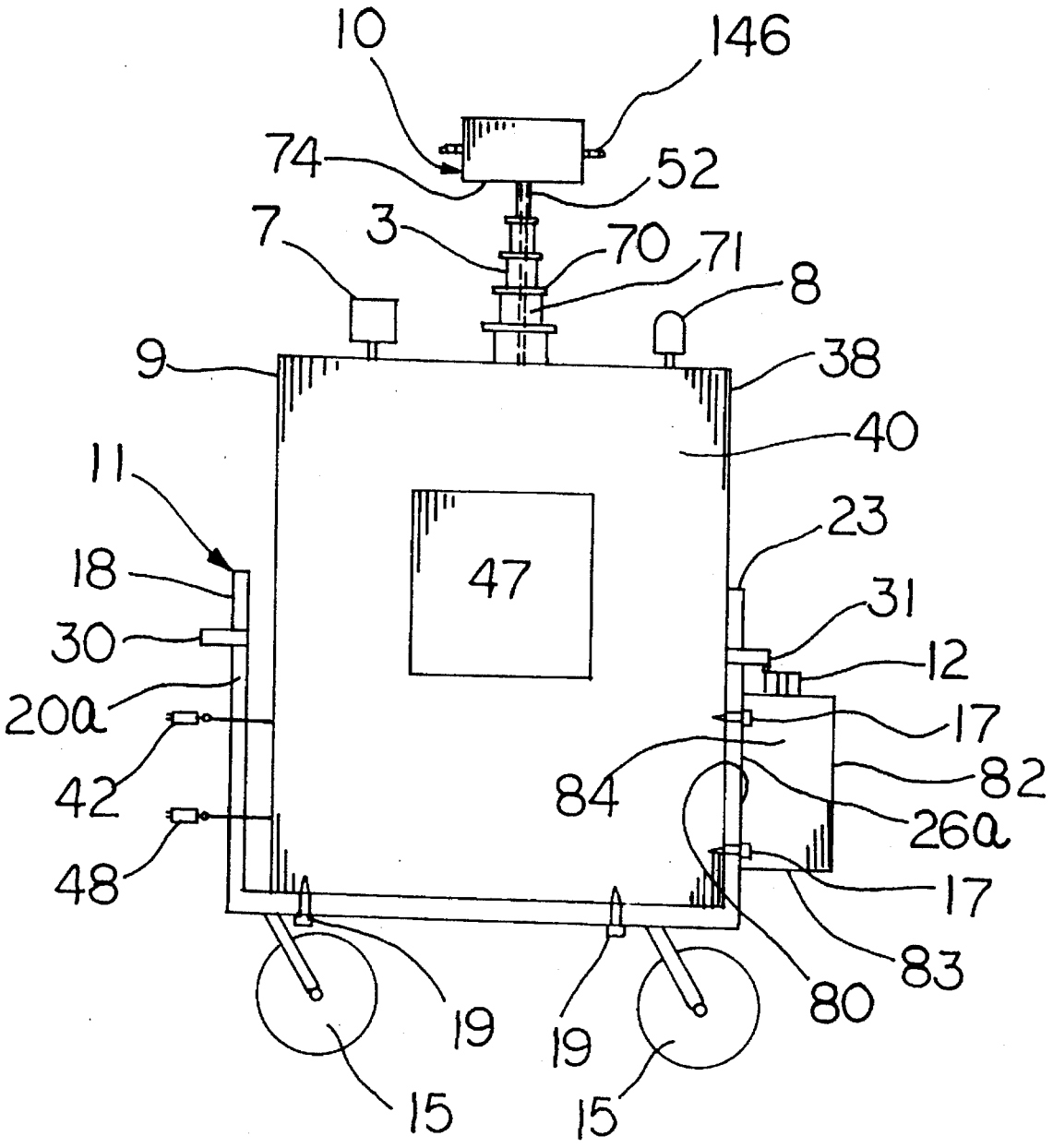
FIG. 2 shows a right side elevational view of the mobile fire detector system.
Figure 4:
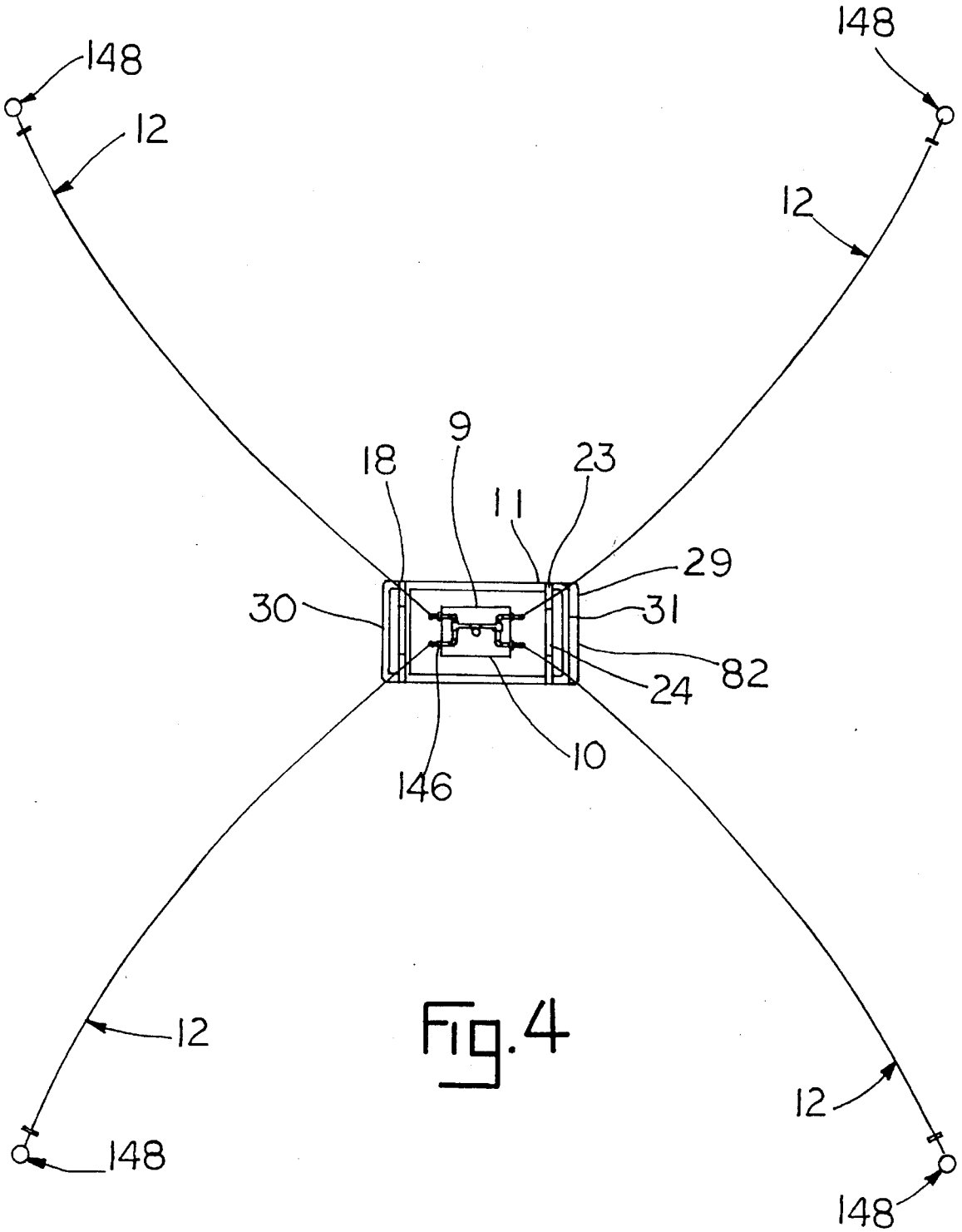
FIG. 4 shows a top plan view of the mobile fire detector system in an extended position with the connector box near the ceiling and the hoses connected to the lateral outlets.
Figure 10:
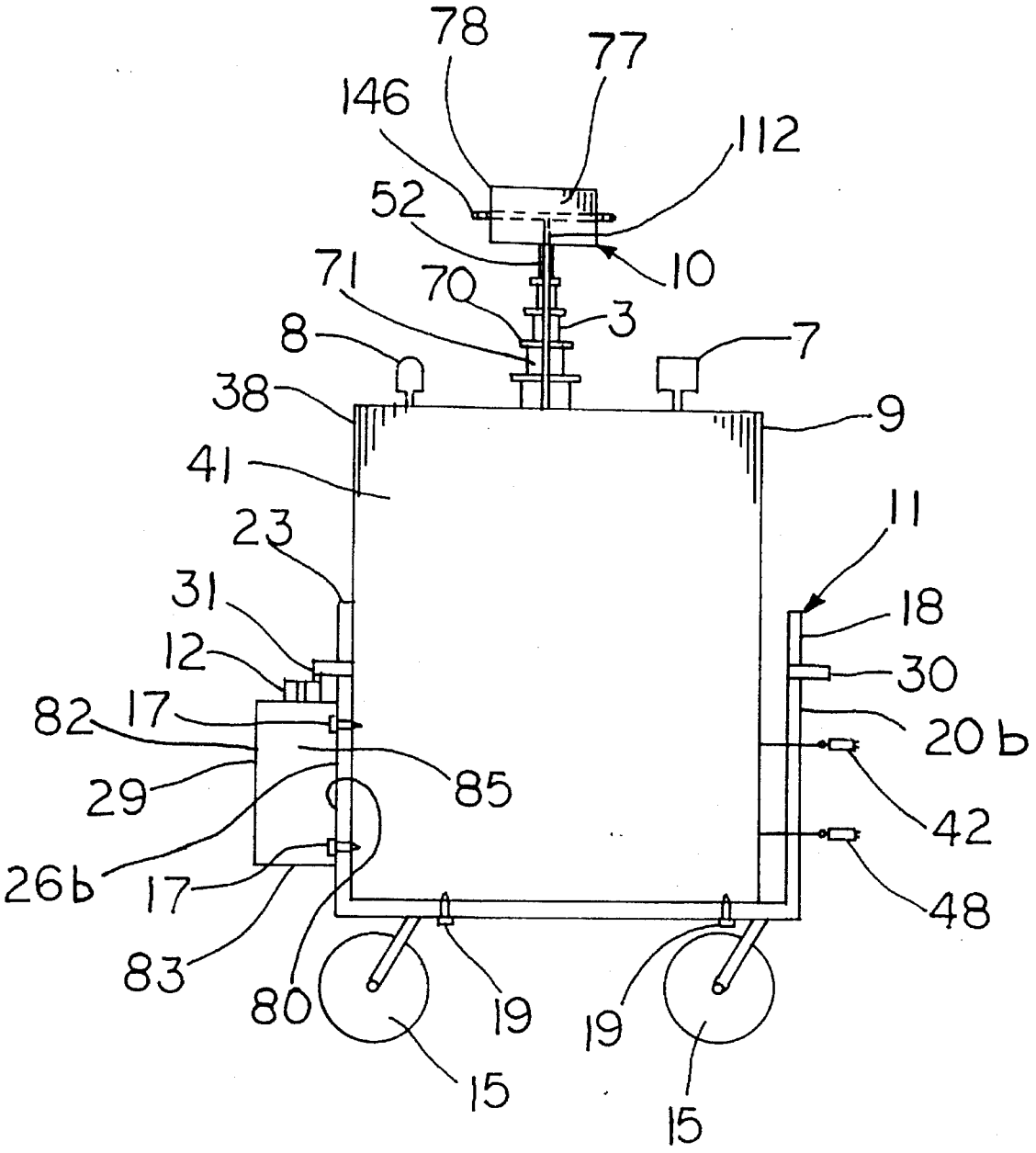
FIG. 10 shows a left side elevational view of the mobile fire detector system.

Referring to FIG. 1, the mobile fire detector system 14 has a cart 11 having a rectangular floor or platform 16 supported by four wheels 15 rotatably connected to it in a conventional manner. The wheels 15 are swivel casters and generally composed of mold-on rubber or other suitable material. An inverted U-shaped handle 18 having an upper bar 22 and legs **20*a* and 20*b* is integrally attached (FIG. 2) at the ends of its legs to the front end of the platform 16. The handle 18 extends upwardly and is generally perpendicular to the platform 16. A crossbar 30, extending slightly outward, is welded between the two legs 20*a* and 20*b* approximately at the front surface of the intersection of the legs and upper bar 22. A similar U-shape handle 23, as also shown in FIGS. 2, 4, and 10, having an upper bar 24 and legs 26*a* and 26*b* is integrally attached at the ends of its legs to the rear end of the platform 16. The handle 23 extends upwardly and is generally perpendicular to the platform 16. A crossbar 31, extending slightly outward, is welded between the two legs 26*a* and 26*b* approximately at the rear surface of the intersection of the legs and upper bar 24**. The handles and platform are generally composed of steel or other suitable material.

Figure 7:
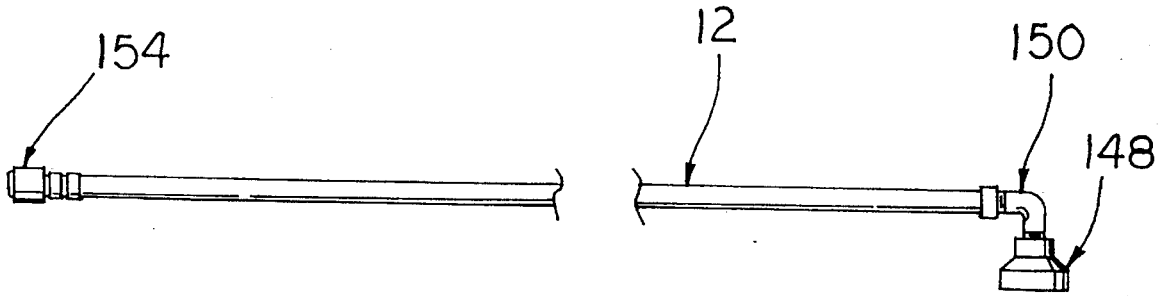
FIG. 7 shows a side view of a sensing hose.

An accessory box 29 having a flat bottom wall 83, upstanding front wall 80, rear wall 82, and opposite side walls 84 and 85 is fixedly mounted by self tapping screws 17 at its front wall 80 to the legs **26*a* and 26*b* of rear handle 23 as shown in FIGS. 1,2,4 and 10. The box is generally composed of steel or other suitable material and is primarily used for storing sensing hoses 12. As shown in FIG. 7, each sensing hose 12 is preferably ⅜ inch in diameter and 17 feet long and has a quick lock hose plug coupling 154 fastened at one end and an ell fitting 150 connected at the other end. A sampling head 148 for sampling air is connected to the open end of the ell fitting 150**.

A rectangular steel enclosure 9 (FIG. 1) having flat top and bottom walls 32 and 34, respectively, upstanding vertical front and rear walls 36 and 38, respectively, and upstanding vertical opposite side walls 40 and 41 is fixedly mounted upon the platform by self tapping screws 19 (FIGS. 2 and 10) or other conventional fasteners such as nuts and bolts. The enclosure 9 is also fixedly mounted by self tapping screws 17 (FIGS. 2 and 10) to the rear handle 23 for more lateral support. The enclosure houses elements of the mobile fire detector and has a window 47 centered on the side wall 40 for viewing these elements. This side wall 40 is hinged to the front wall 36 and thus forming a door panel to provide access to the interior of the enclosure.

Figure 5:
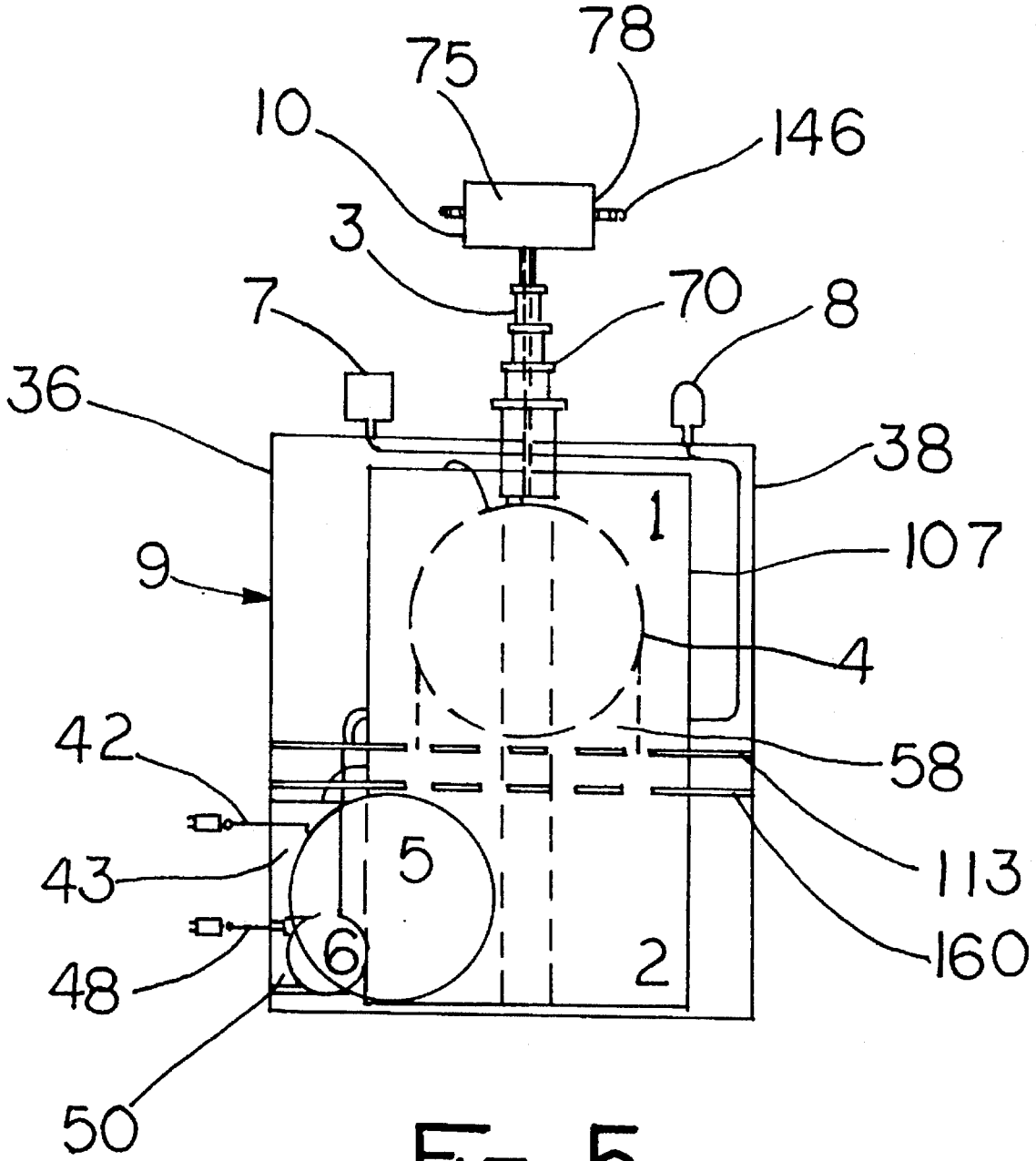
FIG. 5 shows a right side sectional view of the mobile fire detector system without the cart and with the side wall of the enclosure cut away to show the interior.
Figure 6:
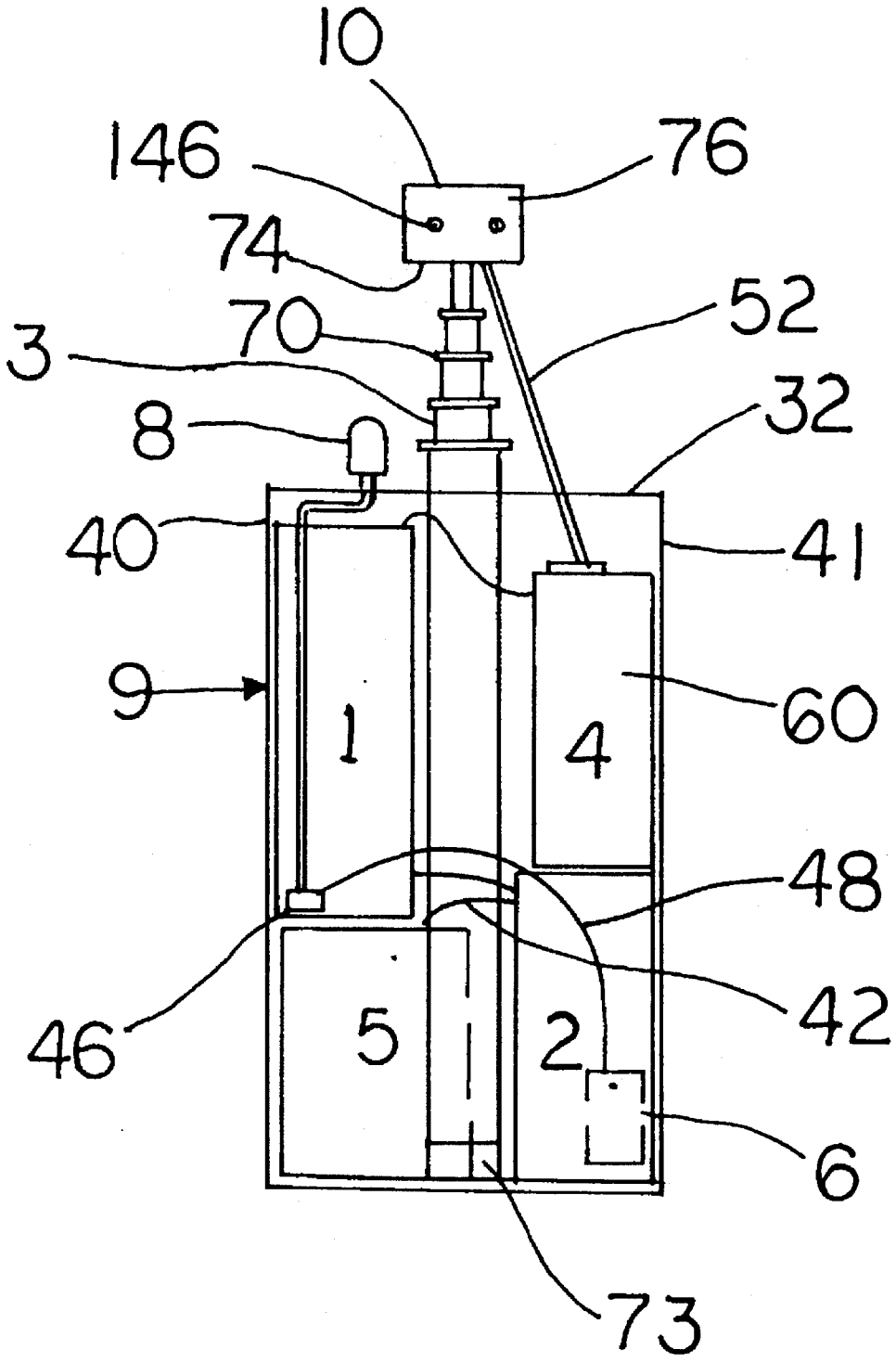
FIG. 6 shows a rear sectional view of the mobile fire detector system without the cart and with the rear wall of the enclosure cut away to show the interior.
Figure 9:
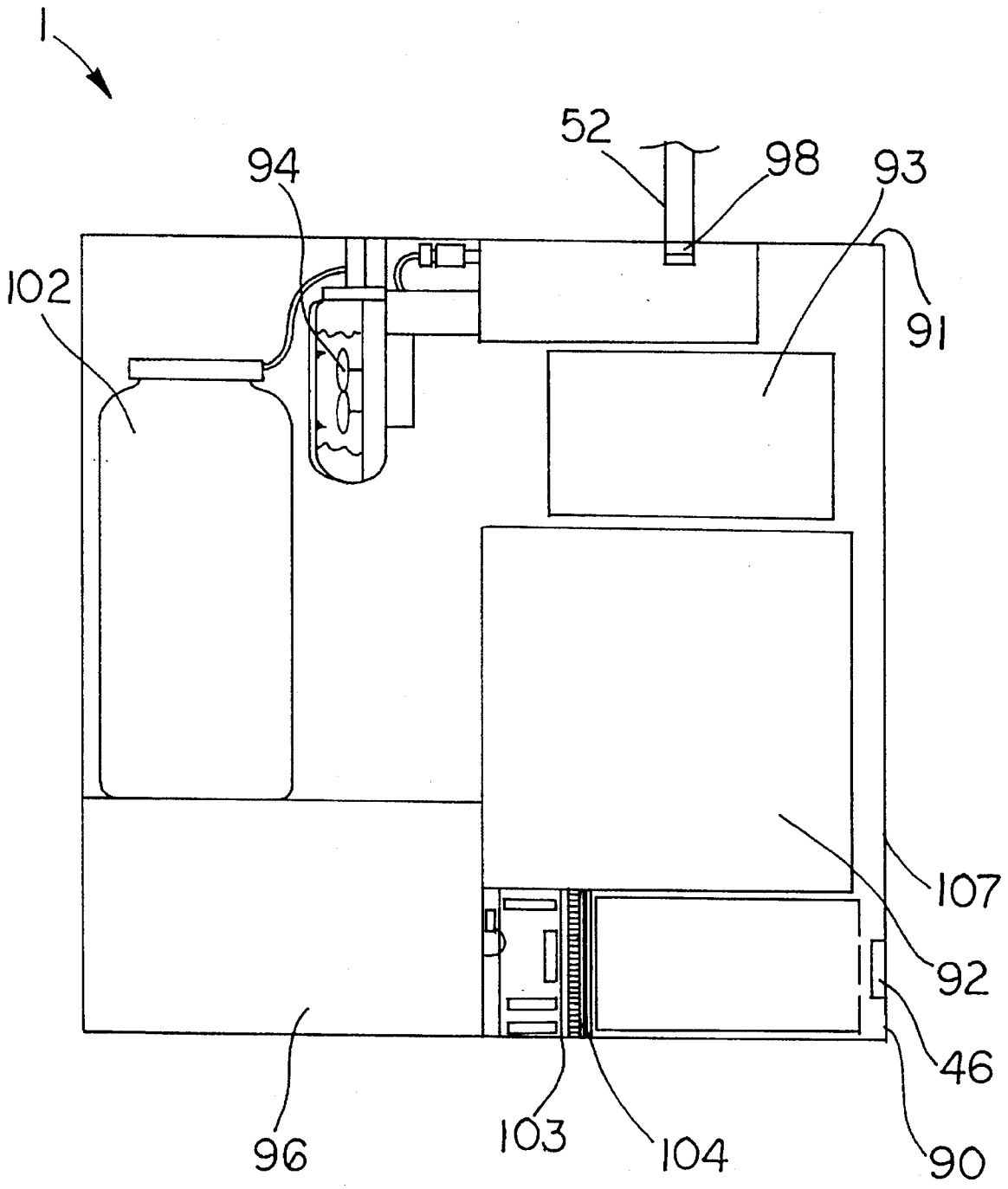
FIG. 9 shows a sectional view of the air sampling fire detector showing the interior of the cabinet.

As shown in FIGS. 5 and 6, an air sampling fire detector 1 (IFD Cirrus 90) manufactured by Environment One Corporation is fixedly mounted on a rectangular plate 160 that is parallel to the bottom wall 34 and affixed at its edges to the inside of the front and rear walls 36 and 38 by conventional means such as nuts and bolts. The air sampling fire detector 1 is located adjacent the side wall 40 for easy acess to service. The air sampling fire detector 1 is a single zone, microcontroller-based fire detector which utilizes the Wilson Cloud Chamber principle to detect submicron particles which are generated by a fire at the incipient stage, which is the overheating stage prior to visible smoke being released. The air sampling fire detector 1 as shown in FIG. 9, includes primarily a threaded inlet 98 connected at the top wall 91 of a metal cabinet 90. The cabinet 90 houses a blower 94 for drawing air into the system. The blower is enclosed by a protective housing fixedly mounted to the cabinet 90, and is in communication with the inlet 98 and a cloud chamber 96 placed inside the cabinet to draw air samples to the cloud chamber. A water bottle 102 is connected to the cloud chamber 96 to humdify each of the air samples. A microcontroller 92 communicating with a cloud chamber 94 is mounted inside the cabinet 90. A power supply 93 is connected to the microcontroller 92 to provide 24 VDC at 100 watts. The air sample is interrogated once every second by the cloud chamber 96 for the presence of high levels of thermally produced, submicron particles. A continuous analog signal is generated corresponding to the particle level in the sampled air. The signal is used to provide a staged alarm sequence at three separate and programmable particle levels. An output strip 103 having contact closures 104 are provided for each of the three alarm points.

As shown in FIG. 5, the air sampling detector 1 is adapted to be plugged into a standard outlet that supply 120 VAC to the air sampling fire detetor 1 by an electric cord 42. In the event of a power failure, a standby power supply 2, fixedly mounted to the inside of the bottom wall 34 adjacent the side wall 41 of the enclosure 9, is electrically connected to the air sampling detector to supply the necessary power. The electric cord 42 is wrapped around a spring retractable electric cord reel 5 preferrably a Series 4000 manufactured by Reelcraft. The electric cord reel 5 is fixedly mounted at its base 43 to the inside of the front wall 36 of the enclosure 9 by conventional means such as nut and bolts and located under the plate 160. The electric cord 42 is routed from the reel to the standby power supply 2.

A fire communicator 46, preferably model 5104 manufacture by Silent Knight, is fixedly mounted inside the cabinet 90 to its side 107 (FIG. 6 and 9) and is electrically connected to the air sampling detector 1 at one of its three alarm and trouble output contacts 104. A phone cord 48 is electrically connected to the fire communicator 46 and is wrapped around a spring retractable phone cord reel 6 preferably a Series 4000 manufactured by Reelcraft. The reel 6 is fixedly mounted at its base 50 to the front wall 36 of the enclosure 9 adjacent the side wall 41 as shown in FIG. 5. A fire alarm horn 7 and strobe light 8 are fixedly mounted on top of the top wall 32 of the enclosure 9 and are each electrically connected through electrical knockouts to the air sampling fire detector 1 (FIGS. 5 and 6) at one of its three alarm and trouble output contacts 104. The fire alarm horn 7 is also connected in a commonly known circuit having an electrical relay wired between an alarm and trouble output contact 104 and the 24 D.C. voltage line coming off the power supply 93 so that the proper voltage can activate the horn 7. The strobe light 8 is connected in a similar circuit. In operation, an electric signal having a level indicative of a fire condition is outputted from the alarm contact and energizes the relay to connect the contact to the voltage line activating the device.

Figure 8:
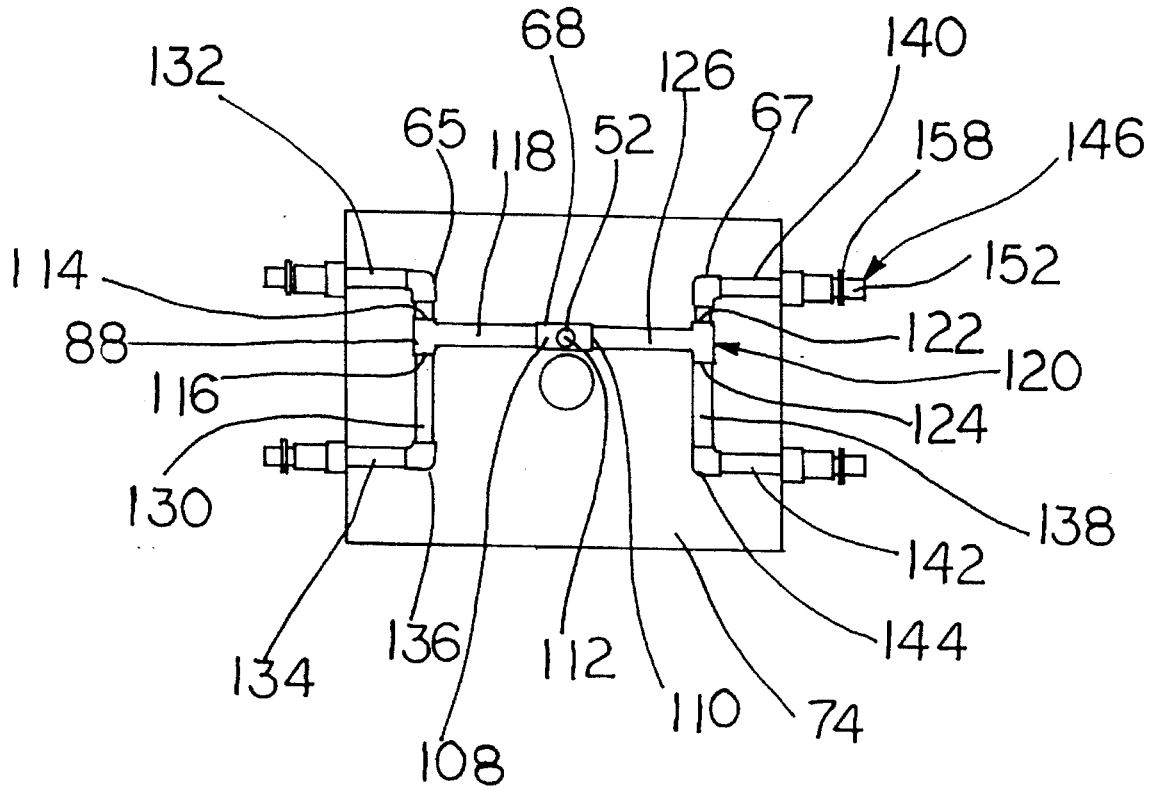
FIG. 8 shows a top plan view of the connector box with the top wall cut away to show the piping network.

A hose 52 preferably a half inch in diameter is connected to the inlet 98 of the air sampling fire detector 1 (FIGS. 5, 6, and 9) and wrapped around a self-retractable hose reel 4 (FIG. 5) preferably a series 7000 model manufactured by Reelcraft. The reel 4 is enclosed by a rectangular box 60 located adjacent the side wall 41 (FIG. 6), and fixedly mounted at its base 58 to the bottom wall of the box 60 which is mounted to a rectangular plate 113 (FIG. 5). The plate 113 is affixed at its edges to the front and rear walls 36 and 38 and is parallel to the bottom wall 34 of the enclosure 9. The other end of the hose is routed through an opening in the bottom wall 74 and is connected to the base leg 112 (FIG. 10) of a hollow bras Tee fitting 68. The connector box 10 as shown in FIGS. 1 and 10 further has a flat top wall 72, upstanding vertical front and rear walls 76 and 78 respectively, and upstanding vertical side walls 75 and 77. The connector box 10 houses a piping network 64 similar to a manifold as shown in FIG. 8. The manifold or piping network 64 includes the brass Tee fitting 68 which is vertically oriented. The Tee fitting 68 has arm members 108 and 110 and the base leg 112 (FIG. 5) with all having hollow interiors which are in communication with one another. A hollow brass Tee fitting 88 having arm members 114 and 116 and base leg 118 with all having hollow interiors which are in communication with one another is aligned and connected to the open end of the arm memer 108 at the end of its base leg 118 such that the arm members 114 and 116 are horizontally oriented. A hollow brass Tee fitting 120 having arm members 122 and 124 and base leg 126 with all having hollow interiors which are in communication with one another is aligned and connected to the open end of the arm member 110 at the end of its base leg 126 such that the arm members 122 and 124 are horizontally oriented.

The piping network further includes opposite hollow U-shaped portions 65 and 67 that are laterally oriented. The U-shaped portion 65 has a base 130 and legs 132 and 134 connected to the base by ell fittings 136. Arm members 114 and 116 of Tee fitting 88 are connected to the base 130 and are in communication with it. The U-shape portion 67 has a base 138 and legs 140 and 142 connected to the base by ell fittings 144. A lateral outlet 146 is formed at the free end of each leg of the U-shaped portions, and bored through its adjacent front or rear wall 76 and 78 of the box 10. In this manner, the box 10 laterally supports the manifold 64. Each outlet 146 has a quick lock FPT socket coupling 152 that snap fits onto a quick lock hose plug coupling 154 of the sensing hose 12. In more detail, the socket coupling 152 has a collar 158 biased by a spring (not shown) whereby a user pushes back the collar 158 and inserts the plug coupling 154 into the socket coupling 152 and then releases the collar to snap it securely in place locking the hose to the outlet.

As shown in FIG. 4, four sampling heads 148 are used to adequately sample the air. Each sampling head is a device manufactured by Environment One, Corp. and is design for use by the air sampling fire detector 1. The sampling head 148 includes a filter and adjusting screw (not shown) to maintain the air flow at 1.4 liters per head into the air sampling fire detector for different hose lengths and diameters.

Figure 3:
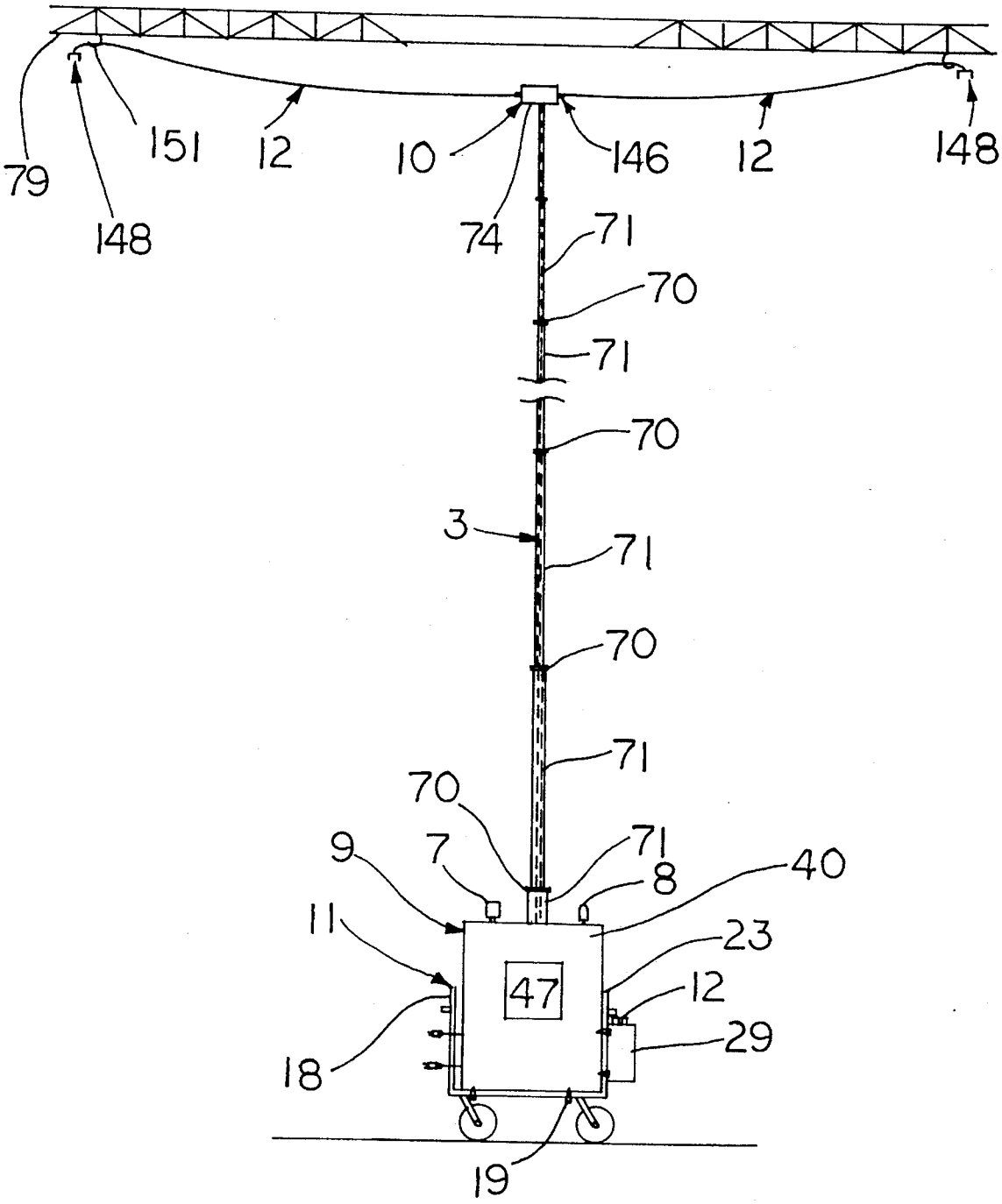
FIG. 3 shows a right side elevational view of the mobile fire detector system in an extended position with the connector box near the ceiling and the hoses connected to the lateral outlets.

As shown in FIGS. 2,3, and 6, the box 10 is welded at its bottom wall 74 to a telescoping mast 3 such as one manufactured by the Will-Burt Company. The telescoping mast 3 has 5 graduated cylindrical aluminum tubes 71 which are nested one inside another with the smallest cylinder being welded to the box 10. A quick lock/release collar 70 is inserted around each tube 71. The mast is extended manually by pushing up the tubes and fixing or locking them in position by turning the quick lock/release collars 70 around the tubes. The base 73 of the telescoping mast is bored vertically through the center of the top wall 32 of the enclosure 9 and is fixedly mounted to the inside of the bottom wall 34.

In operation as shown in FIGS. 3 and 4, the mobile fire detector is pushed to the unprotected area. The four sensing hoses 12 are connectd to the four lateral outlets 146 of the connector box. The telescoping mast and the hose 52 from the reel 4 is then extended elevating the sensing box approximately 12 inches from the ceiling 79 or bar joist. Four hooks 151 are attached to the ceiling to support the sensing hoses. The four sensing hoses 12 are extended diagonally and equally spaced providing a maximum protected area of 3600 square feet as shown in FIG. 4. The location of the sampling heads is critical, since the products of combustion from a fire condition must reach the sampling head in order to be detected. Therefore, the heads are located near the ceiling where the particles from combustion would rise. Further, the sampling heads should be located near natural air currents or in the return air duct, if the room has forced air circulation. This is accomplished by moving the cart and then adjustng the height of the sensing box. The retractable electric cord is then pulled a sufficient length to reach the nearest 120 v AC outlet and then plugged in to provide the neccesary power. The retractable phone cord is pulled a sufficient length to reach the nearest phone jack and plugged in to connect the fire communicator to a supervised station.

The air sampling fire detector 1 is then turned on activating the blower 94 to draw the air through the sampling heads 148 where it is filtered and directed through the sensing hoses 12 and through the hose 52 reaching the inlet 98 of the air sampling fire detector 1. The air is humidified by the water bottle and then routed to the cloud chamber 94. The cyclically operating cloud chamber assembly then acts to produce electrical signals that correspond to the concentraton of particles within the sample. When the concentration of the particles exceed programmable limits indicating fire conditions, the electrical signals are strong enough to energize the relays to activate the strobe light 8 and fire horn 7 to visibly and audibly warn individuals of a fire condition. The signals also activate the fire communicator 46 that notifies personnel in the supervised station of a fire.

After use, the telescoping mast 3 is lowered to its retracted position (FIG. 1). The sensing hoses 12 are snapped off the lateral outlets and placed in the accessory box 29. The electric and phone cords 42 and 48 are unplugged and retracted so that the mobile fire detector is ready to be used again.

The previously described version of the present invention has many advantages, including the incorporation of the wheeled cart to easily transport the rest of the fire detection system to a different room and the telescoping mast and tubular network to position the sampling heads at the ideal location for each room. The accessory box, releasably locking sensing hoses, and retractable phone and electric cords further aid in keeping the system compact and easily transportable, and the fire communicator, alarm, and strobe light provide proper warning to nearby personnel.

Additional changes and modifications to the embodiment of the invention as described herein can also be made, as will be apparent to those skilled in the art, while still remaining within the spirit and scope of the disclosed invention as set forth in the appended claims.

What is claimed is:

1. A portable system for detecting fire conditions in a building comprising:

a body supported by a plurality of wheels for transporting said system to different areas of said building;

detecting means for detecting a fire condition at its incipient stage before visible smoke has been released, said detecting means being carried by said body;

a tubular network communicating with said detecting means;

a plurality of heads connected to said tubular network, each head for sampling air in the surrounding area;

a blower means operatively associated with said detecting means for drawing air through said heads and through said tubular network into said detecting means to test said sampled air for fire conditions; and telescoping means stemming from said detecting means and operatively associated with said tubular network for positioning said heads at selected heights.

2. The system of claim 1 wherein said detecting means has an inlet, said tubular network includes a flexible main hose connected at one end to said inlet of the detecting means, said tubular network further including a manifold connected to the other end of said main hose, said manifold having a plurality of lateral outlets, said tubular network further including a plurality of sensing hoses, each of said sensing hoses connected at one end to each of said outlets, each of said sensing hoses extending laterally and connected at other end to a said head.

3. The system of claim 2 wherein said heads are peripherally spaced equally from each other.

4. The system of claim 2 wherein said manifold is supported and enclosed by a housing.

5. The system of claim 1 including communicating means operatively associated with said detecting means for notifying personnel at another place of said fire condition in response to said detecting means detecting a fire condition.

6. The system of claim 1 including an alarm horn operatively associated with said detector means, said alarm horn activating to audibly warn people of a fire condition in response to said detecting means detecting a fire condition, and a strobe light operatively associated with said detecting means, said strobe light activating to visibly warn people of a fire condition in response to said detecting means detecting a fire condition.

7. The system of claim 2 including means for releasably locking each of said sensing hoses to a said outlet of said manifold.

8. The system of claim 7 including a receptacle affixed to said body for storing said sensing hoses and other accessories.

9. A portable system for detecting fire conditions in a building comprising:

a body supported by a plurality of wheels for transporting said system to different areas of said building;

detecting means for detecting a fire condition at its incipient stage before visible smoke has been released, said detecting means being carried by said body, said detecting means having an inlet;

a tubular network communicating with said detecting means, said tubular network including a main hose connected at one end to said inlet of the detecting means, said tubular network further including a manifold connected to other end of said main hose, said manifold having a plurality of lateral outlets, said tubular network further including a plurality of laterally extending sensing hoses, each of said sensing hoses connected at one end to each of said outlets of said manifold;

a plurality of heads connected to said tubular network, each of said sensing hoses connected at other end to each of said heads, each head for sampling air in the surrounding area;

a blower means operatively associated with said detecting means for drawing air through said heads and through said tubular network into said detecting means to test said sampled air for fire conditions; and positioning means operatively associated with said tubular network for positioning said heads at selected heights, said positioning means being a telescoping mast, said telescoping mast having a plurality of graduated cylinders nested inside each other, said telescoping mast being mounted on said body, said manifold being mounted on the cylinder smaller than the largest cylinders, each of said cylinder including locking means for fixing said cylinders in place upon a user positioning said manifold at a selected height.

10. The system of claim 9 including means for releasably locking said sensing hoses to said outlets of said manifold.

11. The system of claim 10 including a receptacle affixed to said body for storing said sensing hoses and other accessories.

* * * * *